US006563933B1

(12) United States Patent
Niederdraenk

(10) Patent No.: US 6,563,933 B1
(45) Date of Patent: May 13, 2003

(54) ELECTROMAGNETIC TRANSDUCER FOR GENERATING SOUND IN HEARING AIDS, PARTICULARLY ELECTRONIC HEARING AIDS

(75) Inventor: Torsten Niederdraenk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 215 days.

(21) Appl. No.: 09/708,638

(22) Filed: Nov. 9, 2000

(30) Foreign Application Priority Data

Nov. 15, 1999 (DE) ..... 199 54 880

(51) Int. Cl.[7] ..... H04R 1/00
(52) U.S. Cl. ..... 381/417; 381/418; 381/396
(58) Field of Search ..... 381/412, 417, 381/418, 423, 409, 398, 396, 386, 326, 380

(56) References Cited

U.S. PATENT DOCUMENTS 2,548,062 A * 4/1951 Reger ..... 381/154
3,560,667 A * 2/1971 Carlson ..... 381/312
4,272,654 A * 6/1981 Carlson ..... 381/312

* cited by examiner

*Primary Examiner*—Rexford Barnie
(74) *Attorney, Agent, or Firm*—Schiff Hardin & Waite

(57) ABSTRACT

An electromagnetic transducer for generating sound in an electronic hearing aid has a housing containing an electromagnetic drive that has a coil, a drive magnet and an armature arrangement. Further, a membrane arrangement is provided in the housing that is mechanically coupled to the armature arrangement. For reducing vibrations due to the driving and driven parts of the transducer, as well as for improving the efficiency, the membrane arrangement is formed by two separate membranes that are arranged at opposite sides of the drive, are identically fashioned and can be oppositely driven such that the overall mechanical pulse occurring due to the movement of the driven or driving parts is minimized.

17 Claims, 1 Drawing Sheet

ELECTROMAGNETIC TRANSDUCER FOR GENERATING SOUND IN HEARING AIDS, PARTICULARLY ELECTRONIC HEARING AIDS

BACKGROUND OF THE INVENTION

1. Field of the Invention

The present invention is directed to an electromagnetic transducer for generating sound in hearing aids.

2. Description of the Prior Art

An electromagnetic transducer which serves the aforementioned purpose is known, for example, from I. Veit, Technische Akustik, Vogel Verlag, Würzburg, 1978, and has a housing containing an electromagnetic drive that is comprised of a coil, a drive magnet and an armature arrangement. A membrane arrangement that is mechanically coupled to the armature arrangement in order to convert movements of the armature arrangement into sound signals is secured in the housing.

This known electromagnetic transducer has only one armature and one membrane, so that the efficiency of the transducer is limited, and, moreover, the moving parts lead to vibrations of the overall transducer arrangement during operation of the transducer.

SUMMARY OF THE INVENTION

An object of present invention is to provide an electromagnetic transducer wherein the efficiency of the transducer arrangement is improved and feedback phenomena of the device caused by vibrations are avoided or at least diminished.

This object is achieved in accordance with the invention in a transducer of the type described above wherein the membrane arrangement is formed by two separate membranes that are arranged at opposite sides of the drive but are otherwise identically fashioned and are oppositely driven such that the overall mechanical pulse occurring due to the movement of the driven or driving parts is minimized.

The basis of the invention is to consistently implement two principles in the transducer arrangement, namely a highly symmetrical movement of the driving and driven parts and strictly opposed operation of the moving and moved parts such that the overall mechanical pulse occurring due to the movement of these parts is minimized. This results in vibrations being avoided, and thus feedback phenomena can be largely suppressed from the very outset.

In a preferred embodiment, the two membranes are symmetrically arranged relative to the drive. This is a consistent development of the symmetry concept.

In a further embodiment, an air space in communication with an output connecting piece of the housing is enclosed between the two membranes. Due to the opposite drive of the movement of the two membranes, a considerable improvement in the efficiency is achieved, so that an adequate performance of the transducer can be fundamentally achieved with smaller, i.e. less disruptive, movements of the driving and driven parts, which in turn assists in the reduction of the vibrations causing feedback.

In a further embodiment, the armature arrangement has two separately movable armatures. Each armature is connected to one of the membranes. This leads to a further symmetry of the overall structure and of the individual components. The two armatures can be identically fashioned and can be pre-mounted in conjunction with the two membranes.

In an embodiment of the invention two separate armatures are arranged between the respective poles of a drive magnet and the middle region of the membranes and proceed parallel to the membranes, at least in sections. The membranes are centrally connected to the armatures. Given excitation of the field coil, the armatures are either opposite attracted or repelled in common by the drive magnet, leading to an opposite but symmetrical movement of the membranes as well as of the drive parts.

In another embodiment the drive magnet arranged between the membranes is centrally divided, but the armatures are not arranged between the ends of the drive magnet and the membranes, but in the form of armature tongues, proceed parallel side-by-side in a center gap of the drive magnet. The connection of the armature tongues to the membranes ensues via a rigid connector element that is secured to the free end of each armature tongue. Both armature tongues merge via intermediate regions bent outwardly from their common plane into a U-shaped end region that is surrounded by a coil. The armature tongues, the middle regions and the U-shaped end region of the armature elements thus form a closed magnetic circuit, which leads to an especially advantageous compensation of the constant magnetic force given employment of the double membrane principle with two armatures.

DESCRIPTION OF THE PREFERRED EMBODIMENTS

Figure 1:
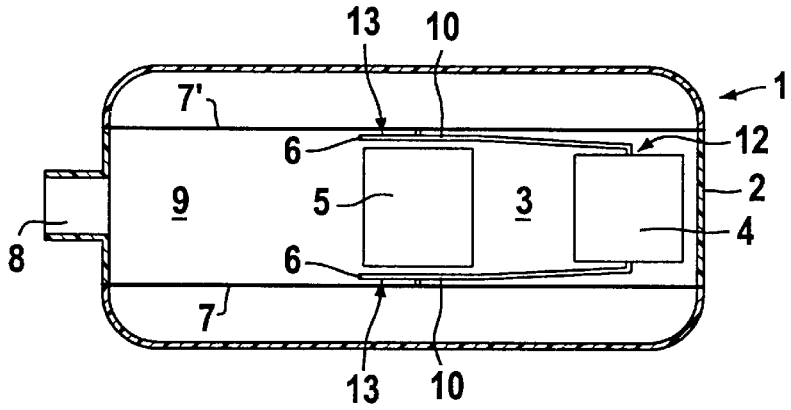
FIG. 1 is a schematic illustration, in section, of an electromagnetic acoustic transducers constructed in accordance with the principles of the present invention.

The electromagnetic transducer 1 shown in FIG. 1 has a housing 2 in which an electromagnetic drive 3 is arranged, formed by a coil 4, drive magnets and an armature arrangement 6. A membrane arrangement also is provided, formed by two separate membranes 7, 7' that are arranged at opposite sides of the drive 3, and that are identically fashioned and that are oppositely driven such that the overall mechanical pulse occurring due to the movement of the driven or driving parts is minimized.

The two membranes 7, 7' are symmetrically arranged with reference to the drive 3 and enclose an air space 9 in communication with an output connector piece 8.

The armature arrangement 6 is composed of two separately movable armatures 10, 10', whereby each armature 10, 10' being connected to one of the membranes 7, 7'. In the exemplary embodiment shown in FIG. 1, the armatures are arranged between the drive magnet 5 and the middle region of the membranes 7, 7' and proceed parallel to the membranes 7, 7' in sections. The two armatures 10, 10' are formed by a U-shaped, resilient element. The coil 4 is arranged in the middle region 12 of the U. The drive magnet 5 is seated between the legs 13 of the U-shaped element.

Figure 2:
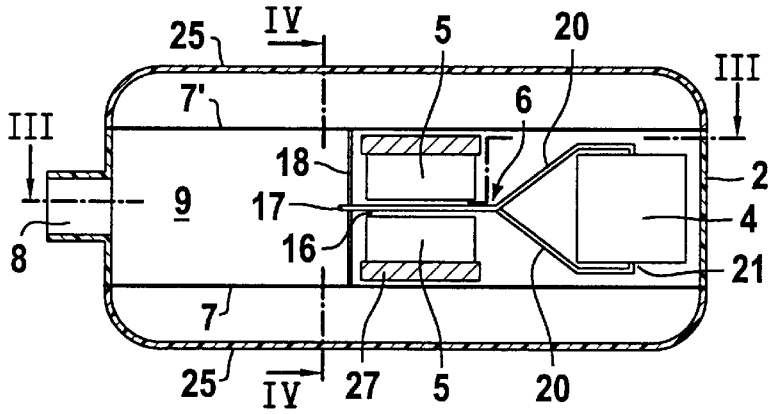
FIG. 2 is a schematic illustration in section of an electromagnetic acoustic transducer with compensated constant magnetic force constructed in accordance with the principles of the present invention.
Figure 4:
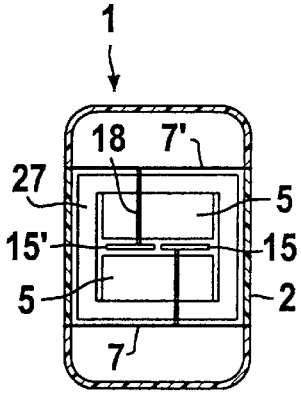
FIG. 4 shows a section along section line IV—IV in FIG. 2.
Figure 3:
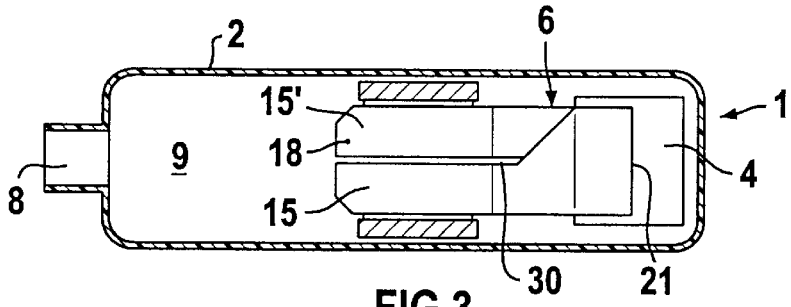
FIG. 3 shows a section along the section line III—III in FIG. 2.

In a second exemplary embodiment shown in FIGS. 2 through 4, the drive magnet 5 is centrally divided. Two armature tongues 15, proceeding essentially parallel side-by-side in the same plane, are arranged in a middle gap 16 of the drive magnet. Each armature tongue 15 is rigidly connected to one of the two membranes 7, 7' via a connector element 18.

The two armature tongues 15 have outwardly bent intermediate regions 20 that proceed from a common plane into a U-shaped end region 21 of the armature arrangement 6 that penetrates the coil 4.

The armature tongues 15, the intermediate regions 20 and the U-shaped end region 21 of the armature arrangement 6 form a closed magnetic circuit.

In all exemplary embodiments, the membranes 7, 7' proceed parallel to the side walls 25 of the housing. In space-saving fashion, the drive magnet that interacts with the two membranes 7, 7' lies therebetween. In the exemplary embodiment shown in FIGS. 2 through 4, the parts of the drive magnet 5 separated by the middle gap 16 are held in a magnetic yoke 27.

It can be clearly seen in FIGS. 3 and 4 that the regions of the armature tongues 15, 15' proceeding parallel to one another and in the same plane are separated from one another by a narrow air gap 30.

Although modifications and changes may be suggested by those skilled in the art, it is the intention of the inventor to embody within the patent warranted hereon all changes and modifications as reasonably and properly come within the scope of his contribution to the art.

I claim as my invention:

1. An electromagnetic transducer for generating sound in a hearing aid, comprising:

a housing having a sound output;

an electromagnetic drive contained in said housing, said electromagnetic drive comprising at least one coil, a drive magnet and an armature arrangement; and a membrane arrangement secured in said housing and mechanically coupled to said armature arrangement for converting movements of said armature arrangement into audible sound, said membrane arrangement comprising two separate membranes disposed at opposite sides of said electromagnetic drive and encompassing an air space therebetween in communication with said sound output, said two separate membranes being identical and oppositely drivable to modulate said air space to produce said audible sound while an overall mechanical pulse which arises due to movement of driven parts and driving parts is minimized.

2. An electromagnetic transducer as claimed in claim 1 wherein said two separate membranes are symmetrically disposed relative to said electromagnetic drive.

3. An electromagnetic transducer as claimed in claim 1 wherein said armature arrangement comprises two separately movable armatures, said two separately movable armatures being respectively connected to said two separate membranes.

4. An electromagnetic transducer as claimed in claim 3 wherein each of said two membranes has a middle region, and wherein of each of said two separately movable armatures has a section disposed parallel to a respective one of said middle regions, between the respective one of said middle regions and said drive magnet.

5. An electromagnetic transducer as claimed in claim 3 wherein said two separately movable armatures, in combination, form a U-shaped resilient element having a central region in which said coil is disposed and having legs between which said drive magnet is mounted.

6. An electromagnetic transducer as claimed in claim 3 wherein said drive magnet is centrally divided, and wherein each of said two separately movable armatures has an armature tongue proceeding substantially parallel and side-by-side in a common plane in a central gap of said centrally divided drive magnet.

7. An electromagnetic transducer as claimed in claim 6 wherein each armature tongue has a free end, and wherein the free end of each of said armature tongues is connected via a connector element, to a respective one of said two membranes.

8. An electromagnetic transducer as claimed in claim 6 wherein said armature tongues each have an intermediate region bent outwardly from said common plane to form a U-shaped end region of said armature arrangement which proceeds through said coil.

9. An electromagnetic transducer as claimed in claim 8 wherein said armature tongues, said intermediate regions and said U-shaped end region of said armature arrangement form a closed magnetic circuit.

10. An electromagnetic transducer as claimed in claim 6 wherein said armature tongues have equal dimensions and equal masses.

11. An electromagnetic transducer as claimed in claim 6 wherein said housing has housing sidewalls, and wherein said membranes are disposed parallel to said housing sidewalls.

12. An electromagnetic transducer as claimed in claim 6 wherein said centrally divided drive magnet has magnet elements separated by a center gap, and a magnetic yoke containing said magnet elements.

13. An electromagnetic transducer as claimed in claim 6 wherein said armature tongues are disposed parallel to said membranes.

14. An electromagnetic transducer as claimed in claim 13 wherein said magnetic yoke has sides facing toward said membranes which have at least sections proceeding parallel to said membranes.

15. An electromagnetic transducer as claimed in claim 6 wherein said armature tongues, in said common plane, are separated by an air gap.

16. An electromagnetic transducer as claimed in claim 6 wherein said membranes and said drive magnet are mirror-symmetrically arranged relative to a symmetry plane coinciding with said common plane of said armature tongues.

17. An electromagnetic transducer as claimed in claim 15 wherein each of said armature tongues has a free end, and further comprising respective connector elements respectively connecting the free ends of said armatures to said two membranes, said connector elements being disposed on opposite sides of said air gap.

* * * * *